US006694963B1

(12) United States Patent
Taylor

(10) Patent No.: US 6,694,963 B1
(45) Date of Patent: Feb. 24, 2004

(54) TOUCH TRIGGER FOR ELECTRONIC PAINTBALL GUN

(75) Inventor: Jeremy Taylor, Xenia, OH (US)

(73) Assignee: Smart Parts, Inc., Latrobe, PA (US)

( * ) Notice: Subject to any disclaimer, the term of this patent is extended or adjusted under 35 U.S.C. 154(b) by 0 days.

(21) Appl. No.: 10/384,930

(22) Filed: Mar. 6, 2003

(51) Int. Cl.[7] ..... F41B 11/14
(52) U.S. Cl. ..... 124/32; 124/65
(58) Field of Search ..... 124/32, 66, 67, 124/65, 64, 63

(56) References Cited

U.S. PATENT DOCUMENTS 3,598,412 A * 8/1971 Lippert ..... 273/129 R
3,950,876 A * 4/1976 Wild et al. ..... 42/69.02
6,142,137 A * 11/2000 MacLaughlin ..... 124/72
6,568,381 B2 * 5/2003 Chang ..... 124/32

OTHER PUBLICATIONS

Touch Switch at http://www.aaroncake.net/circuits/touch.htm 2 pages.
Mims, Forrest M. III "Timer, Op Amp & Optoelectronic Circuits & Projects" p. 12 and 13.

* cited by examiner

*Primary Examiner*—Jacob K. Ackun
(74) *Attorney, Agent, or Firm*—Marger Johnson & McCollom

(57) ABSTRACT

A paintball gun includes a touch-activated trigger system. The touch-activated trigger system preferably can cause the initiation of a firing operation of the paintball gun in response to contact with human flesh or a specialized glove.

20 Claims, 8 Drawing Sheets

TOUCH TRIGGER FOR ELECTRONIC PAINTBALL GUN

FIELD OF THE INVENTION

This invention relates generally to pneumatic paintball guns ("markers"). More specifically, this invention relates to pneumatic paintball guns that use electronic circuitry to control one or more paintball gun operations.

BACKGROUND OF THE INVENTION

Paintball is a fast-paced game, and players must be able to fire quickly and accurately to be victorious. Until recently, paintball was played with purely mechanically-operated pneumatic markers. With the introduction of electronic paintball guns, however, a new age in paintball technology was born. Along with electronic control came the ability to precisely control the timing of gun operations. Precise electronic timing enabled much higher firing rates than previously considered possible. The electronic circuitry also made it possible to program these paintball guns with varying firing modes such as semi-auto, 3 or 6 shot burst, turbo, and even full-auto modes. In addition, the extremely light triggers made possible by use of a trigger-actuated microswitch made it possible for users to easily reach high firing rates even in pure semi-automatic mode.

FIGS. 1A–1C are schematic illustrations of two representative conventional electronic paintball guns and a block diagram of a conventional electronic circuit for controlling those guns, respectively. More specifically, FIG. 1A is a schematic cross-sectional view of a representative conventional electro-pneumatic paintball gun 100A. FIG. 1B is a schematic cross-sectional view of a representative conventional electronic sear-type gun 100B. FIG. 1C is a schematic block diagram of an electronic control system 170, such as used to operate the conventional electronic paintball guns 100A, 100B of FIGS. 1A and 1B, respectively.

Referring to FIGS. 1A–1C, the electronic control system 170 of each of these paintball guns 100A, 100B is similar in its primary components. A trigger 118 is configured to actuate a microswitch 128 when pulled. In response to the trigger pull, the microswitch 118 sends a signal to an electronic control circuit 130 to initiate a firing sequence. The electronic control circuit 130 in turn sends a signal to a solenoid operated mechanism 132 to carry out the firing operation.

Referring specifically to FIG. 1A, a conventional electro-pneumatic paintball gun 100A includes a body 110 and a trigger/grip frame 120 housing a trigger 118. An electronic control circuit 130 is typically mounted in the grip frame 120 either in the grip handle 122 or a receiving tray 124. A power source (battery) 126 supplies power to the electronic control circuit 130. A trigger-actuated microswitch 128 is arranged in electrical communication with the electronic control circuit 130, and a solenoid actuated valve 132A is electrically connected to the electronic control circuit 130.

In operation, when an operator pulls the trigger 118, the trigger contacts and actuates the microswitch 128, sending a signal to the electronic control circuit 130. The electronic control circuit 130 responds by sending one or more firing signals to a solenoid of the solenoid actuated valve 132A to control a firing operation of the paintball gun 100A. During the firing operation, the solenoid actuated valve 132A directs compressed gas to a pneumatic piston and cylinder assembly 140. More specifically, pneumatic pressure directed to the piston and cylinder assembly 140 from the solenoid actuated valve 132 drives the piston 140A forward. A hammer 145, connected to the piston 140A, is also driven forward until it strikes a firing pin 144 of a firing valve 142 to fire the paintball gun 100A.

Referring to FIG. 1B, a conventional electronic sear-type paintball gun 100B also typically includes a body 110, a trigger/grip frame 120 housing a trigger 118, and an electronic control circuit 130 powered by a power source 126. A trigger-actuated microswitch 128 is also arranged in electrical communication with the electronic control circuit 130. Unlike the electro-pneumatic paintball gun 100A of FIG. 1A, however, the electronic control circuit 130 of a conventional electronic sear-type paintball gun 100B is connected to a solenoid-operated sear releasing mechanism 132B.

In operation, a pull of the trigger 118 in the electronic sear-type paintball gun 100B closes the microswitch 128, sending an actuation signal to the electronic control circuit 130. The electronic control circuit 130, in turn, sends one or more firing signals to a solenoid of the solenoid-operated sear releasing mechanism 132B to fire the paintball gun. In particular, in response to the firing signals from the electronic control circuit 130, the solenoid drives a rod that contacts and releases the sear 134 from a hammer 145. Releasing the sear 134 allows spring pressure to drive the hammer 145 forward to strike a firing pin 144 of a firing valve 142 and fire the paintball gun 100B.

Using a trigger-actuated microswitch to initiate the firing sequence provides an increased ease of firing and a corresponding increase in the maximum achievable firing rate as compared to conventional mechanically-actuated paintball guns. Unfortunately, however, electronic trigger systems of conventional electronic paintball guns have several problems.

Among other problems, conventional electronic paintball guns must be set to a safe mode or turned off completely before the trigger is rendered inactive. Otherwise, the gun will fire if anything presses against the trigger. Furthermore, the sensitivity of the electronic trigger on many electronic guns can be too easily adjusted. Unfortunately, this means that the trigger may be made so sensitive that simply jostling the gun will cause it to fire. The trigger may be made so light, for example, that the paintball gun may fire unintentionally when set down or bumped. During non-game time, accidental firing presents a serious safety issue if a barrel plug is not in place; and, at the very least, becomes inconvenient for a player who must clean out the barrel when a plug is in place. During game time, unintentional firing may result in the accidental elimination of the player themselves or a teammate. It is therefore desirable to have a trigger mechanism that protects against accidental firing.

At the same time, however, another problem with conventional electronic triggers is that if the trigger is made too difficult to actuate, the force and motion required to fire the paintball marker will adversely affect the accuracy of the marker, as well as the speed with which the marker can be fired.

It would be desirable to have a way to permit extremely easy intentional actuation of an electronic trigger system, while at the same time more effectively preventing accidental actuation of the triggering mechanism. The industry would be benefited by an electronic paintball gun having a trigger assembly that is easy to fire at a rapid firing rate, yet difficult to fire accidentally.

SUMMARY OF THE INVENTION

According to one aspect of this invention, a touch trigger optimizes accuracy of a paintball gun because only a very light contact by an operator is required to fire the paintball marker. In contrast to some competition firearms, which have a "hair trigger" that requires very little force to move the "hair" required to activate the firearm, the touch or "air" trigger, according to a preferred embodiment of this invention, preferably activates without requiring any trigger movement, and instead requires only slight contact with the user's skin or a specialized glove, for instance, to actuate. Accordingly, a marker constructed to implement various principles of the present invention can be held still while firing. Rapid fire is also optimized because the trigger does not need to move.

According to another aspect of this invention, safety can be improved by configuring the trigger to respond only to the touch of the person holding the gun. In this configuration, neither jostling nor even a direct impact to the trigger by any other object will cause it to fire.

According to one specific embodiment, a touch trigger can include a touch plate. A touch trigger circuit, which can be integrated directly into the electronic control circuit or can be a separate circuit, preferably energizes the touch plate to detect contact made to it by a gun operator. If used to retrofit an existing electronic marker, the touch trigger circuit can be used in place of the conventional electronic trigger and its physically-operated microswitch. When the touch trigger circuit detects a touch on the touch plate, the circuit preferably closes a switching mechanism such as a relay. The touch circuit can be configured to sense only a touch by the operator, or can be configured to respond to any contact with human skin or a specially-adapted glove, for example.

In various alternative embodiments, a paintball gun can incorporate multiple touch plates on a single trigger to enable faster firing or to enable different firing modes, for example. In one specific alternative embodiment, the trigger can include two touch plates. Touching only a first touch plate could, for instance, initiate a semi-automatic firing mode. Touching only a second touch plate could, for example, initiate a burst firing mode. And touching both touch plates simultaneously could activate a full-auto firing mode or some other firing mode or feature. Any other number of touch plates can be used and configured to perform any desired function(s) when actuated. In addition, the touch plates need not be arranged on the trigger, but can be arranged at any desirable location on the paintball gun or remote from the paintball gun.

In yet another alternative embodiment, a hybrid triggering system could be implemented in which a user could selectively choose a touch activation system or a conventional microswitch activation system. Still other embodiments will be readily apparent to those of skill in the art and are within the scope of the invention.

BRIEF SUMMARY OF THE DRAWINGS

The foregoing and additional objects and advantages of the present invention will become more readily apparent through the following detailed description of preferred embodiments, made with reference to the accompanying drawings, in which.

DETAILED DESCRIPTION OF PREFERRED EMBODIMENTS

Various preferred aspects and embodiments of the present invention will now be described in detail with reference to the accompanying figures. It should be noted, however, that the following description is provided by way of example only and not of limitation, and that many other implementations and embodiments of the present invention will be readily apparent to those skilled in the art based on the disclosure herein. The scope of the invention should therefore not be limited to the particular embodiments described herein.

Figure 2A:
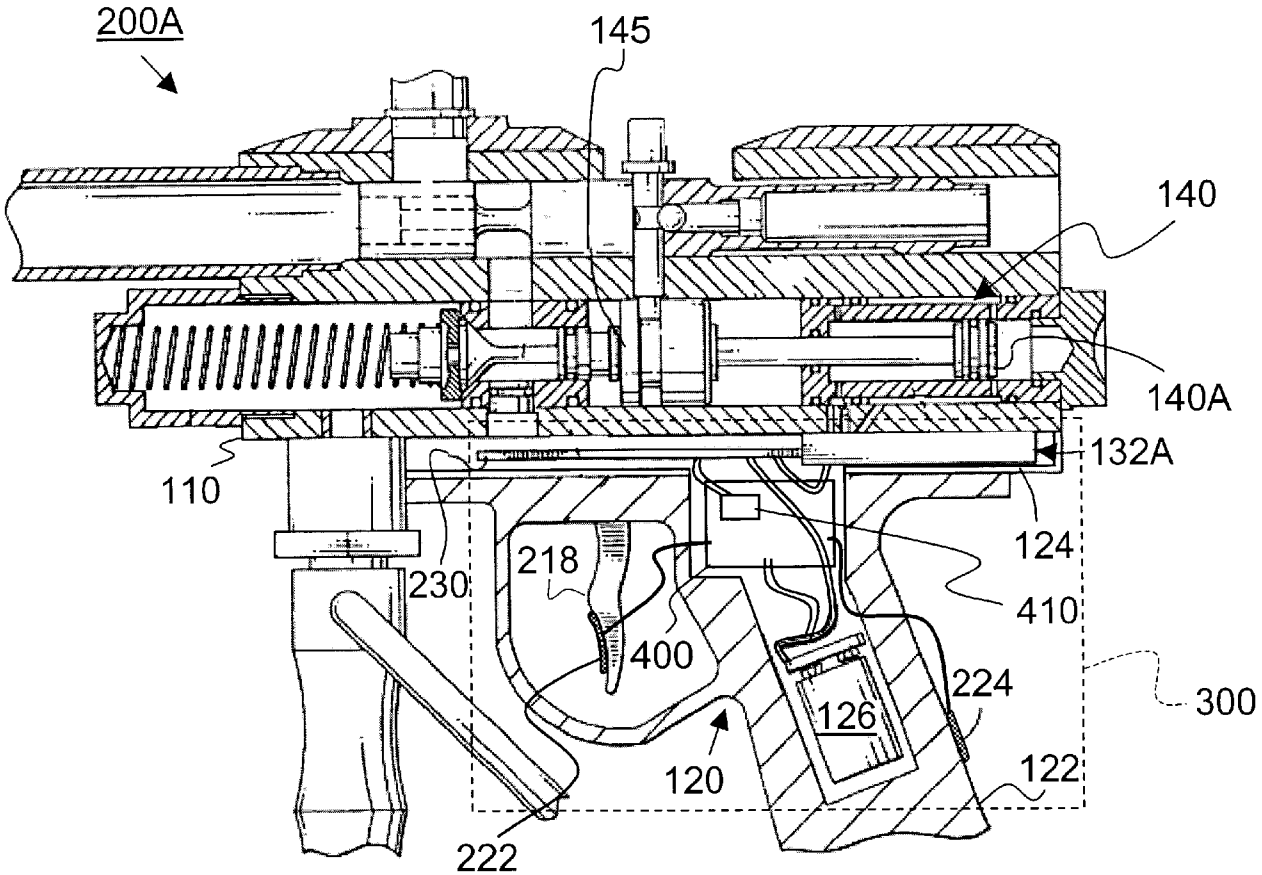
FIG. 2A is a schematic cross-sectional view of a paintball gun including a touch trigger circuit, according to one embodiment of the present invention.
Figure 2B:
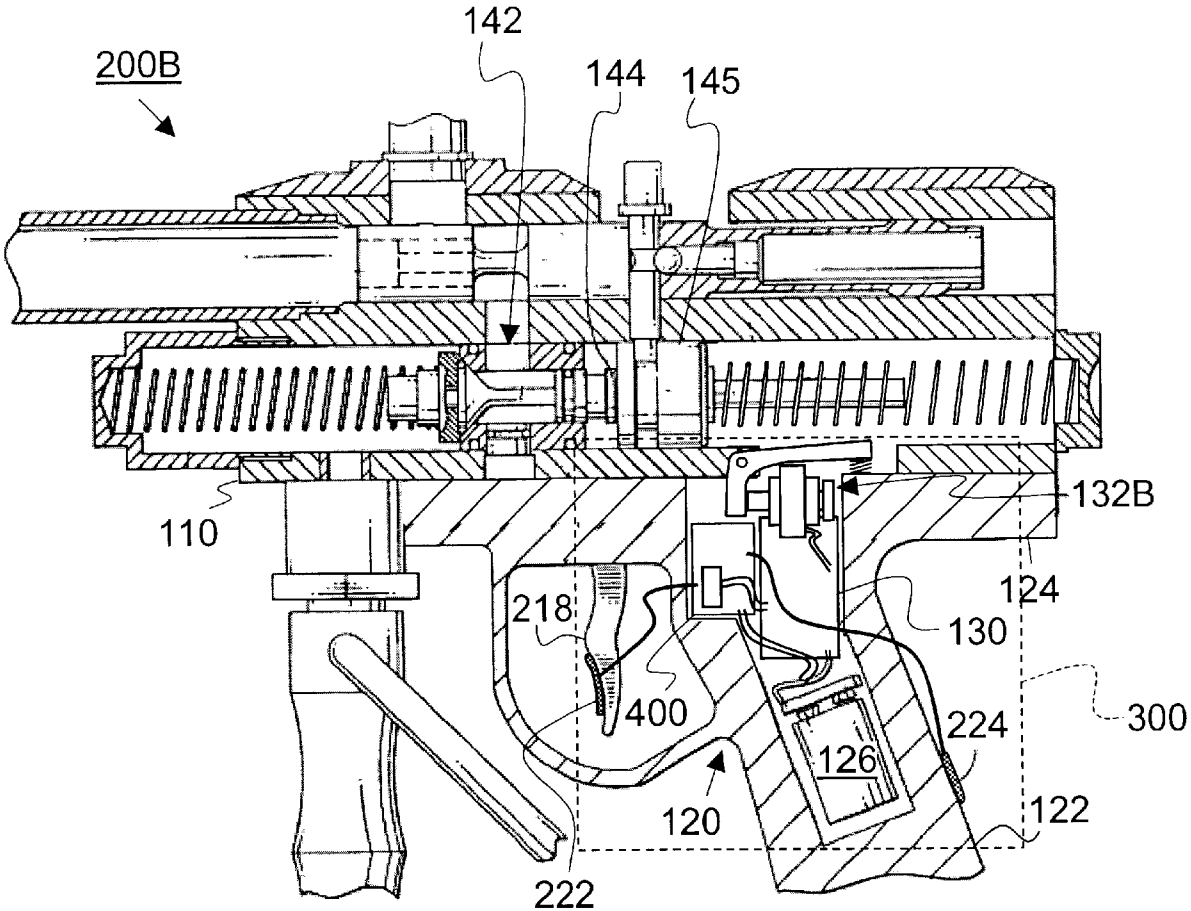
FIG. 2B is a schematic cross-sectional view of a electronic sear-type paintball gun including a touch trigger circuit, according to another embodiment of the present invention.
Figure 3:
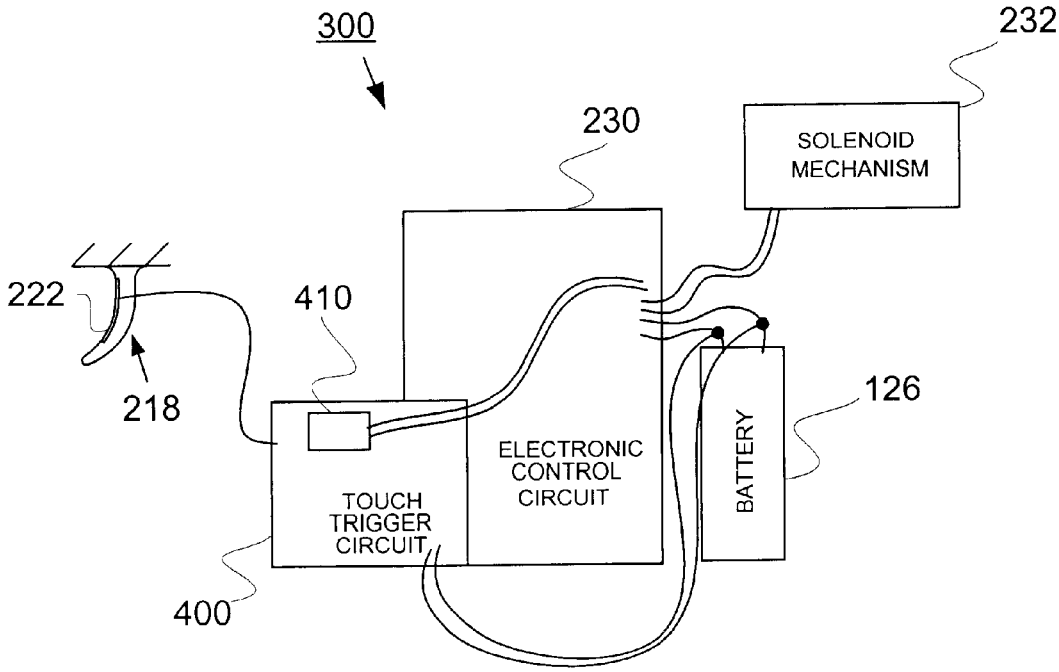
FIG. 3 is a schematic block diagram of one embodiment of an electronic control system of the paintball guns of FIGS. 2A and 2B.

For example, FIGS. 2A and 2B are schematic cross-sectional views of touch-activated electronic paintball guns 200A, 200B, constructed according to exemplary embodiments of the present invention. FIG. 3 is a schematic block diagram of an exemplary embodiment of an electronic control system 300 for the paintball guns 200A, 200B of FIGS. 2A and 2B.

Figure 1A:
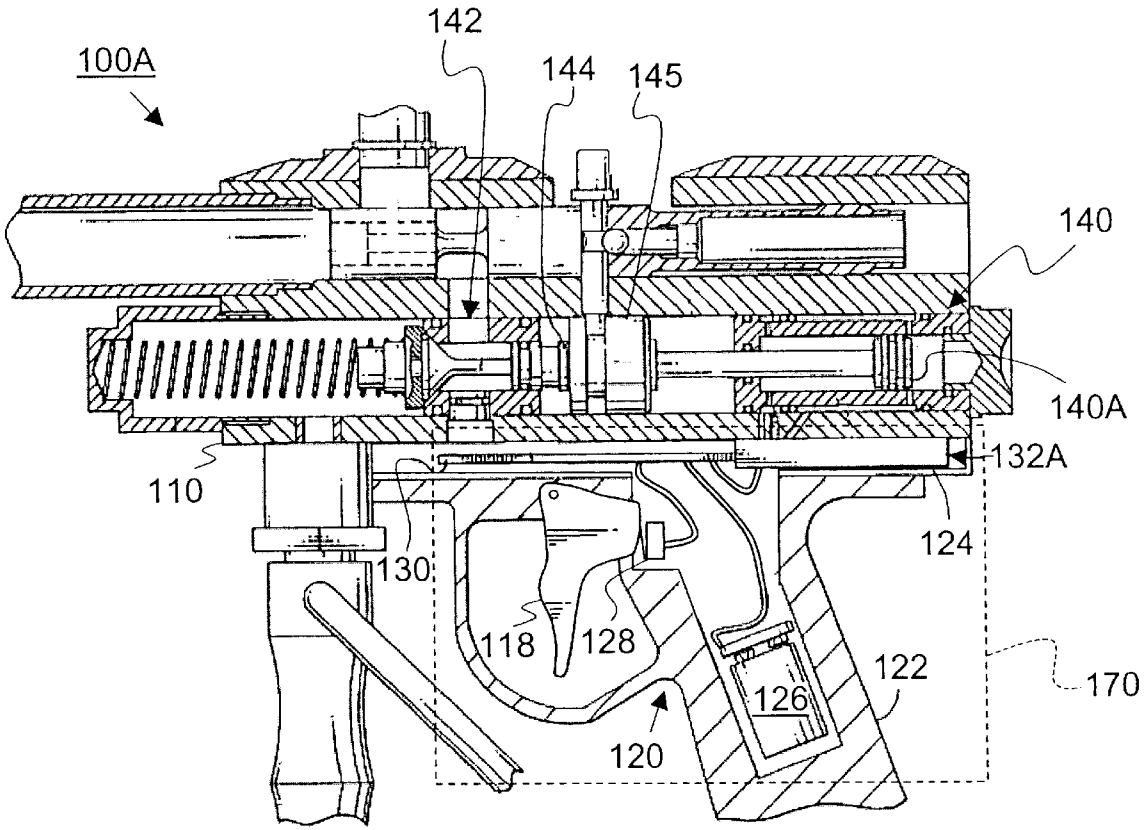
FIG. 1A (Background Art)
FIGS. 1A–1C are schematic illustrations representative of conventional electronic paintball guns and of a conventional electronic control system for operating those guns.
Figure 1B:
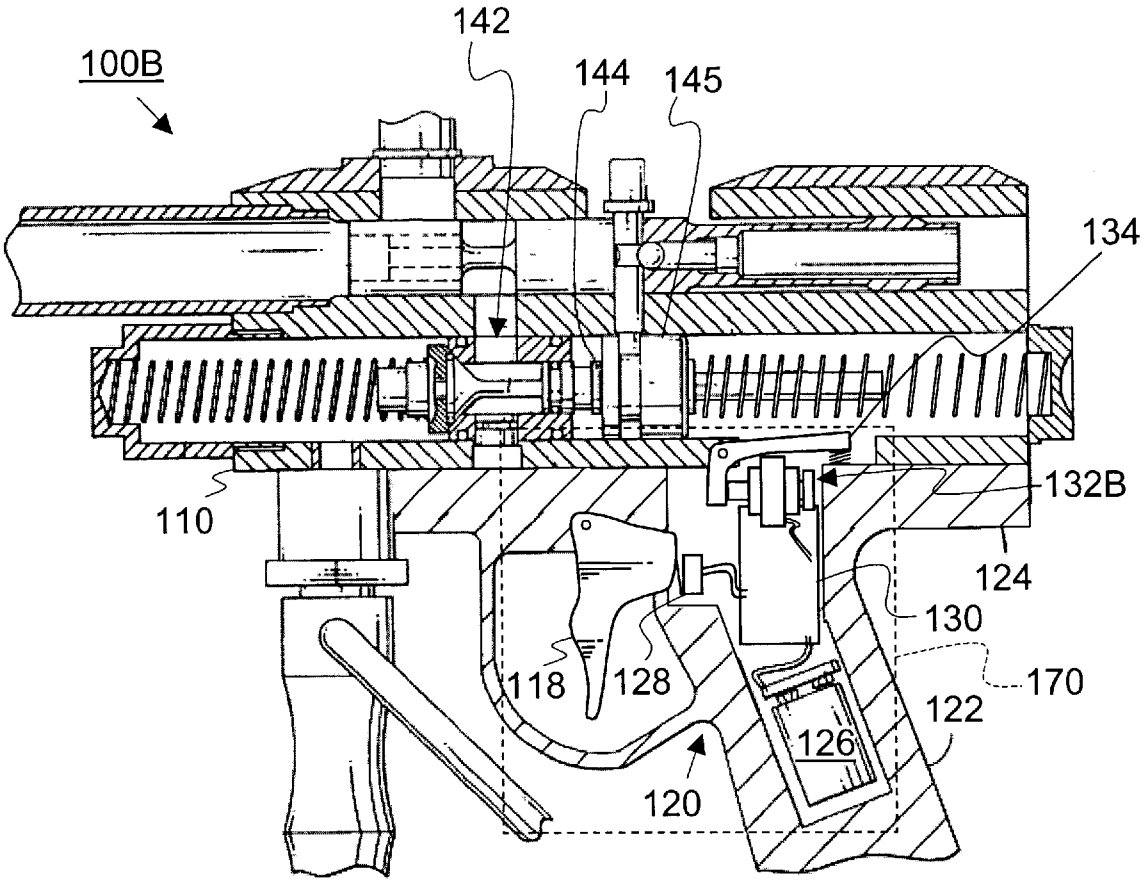
FIG. 1B (Background Art)
Figure 1C:
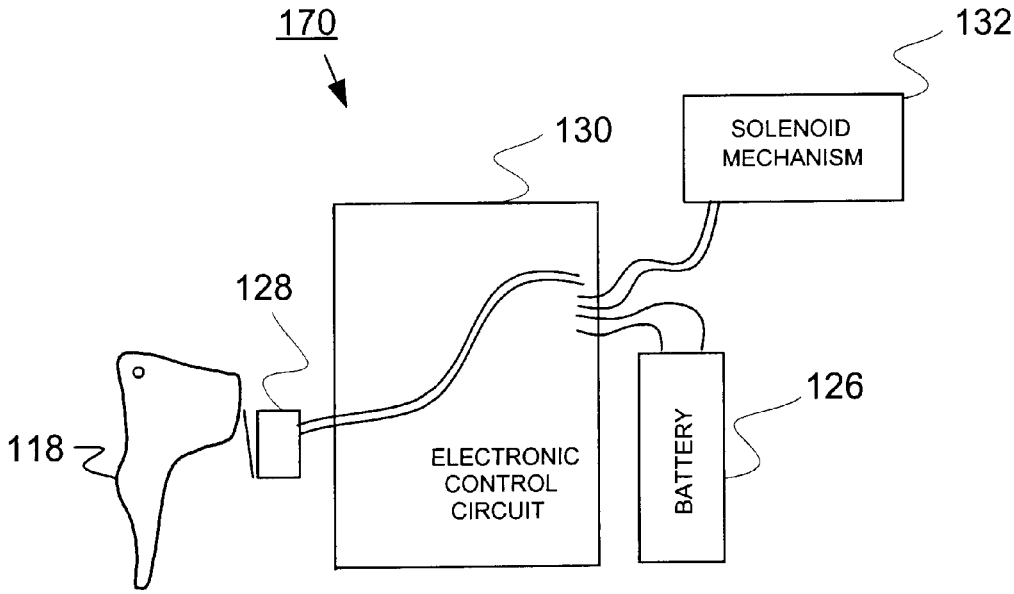
FIG. 1C (Background Art)

Referring to FIGS. 2A, 2B, and 3, as in the conventional paintball guns 100A, 100B described earlier, the paintball guns 200A, 200B preferably include a body 110 and an electronic grip frame 120 attached to or integrated with the body 110. The electronic control system 300 is preferably arranged within the body and/or the grip frame 120. The electronic control system 300 can include elements such as an electronic control circuit 230, a power source 126, and a solenoid actuated mechanism 132A, that are similar to components of the conventional paintball guns 100A, 100B of FIGS. 1A, 1B, and 1C respectively. In addition, however, the electronic control system 300 preferably includes a touch (or "air") trigger circuit 400. The touch trigger circuit 400 can be implemented separate from the control circuit 230 or can be integrated into the control circuit 230. The power source 126 preferably supplies power to both the touch trigger circuit 400 and the electronic control circuit 230. The touch trigger circuit 400 communicates with a touch plate 222 arranged on a trigger 218.

In operation, the touch trigger circuit 400 senses when an operator touches the touch plate 222 of the trigger 218. In response to the touch on the touch plate 222, the touch trigger circuit 400 activates a switching mechanism, such as relay 410 to signal the electronic control circuit 230 that the trigger 218 has been actuated. The electronic control circuit 230 then initiates a firing operation in response to the activation of the switching mechanism 410.

In the electro-pneumatic embodiment of FIG. 2A, the solenoid actuated mechanism 132A is preferably a solenoid valve. In the electronic sear-type embodiment of FIG. 2B, the solenoid actuated mechanism 132B is preferably a solenoid-controlled sear 132B. Whether the mechanism is a solenoid valve 132A or a solenoid-controlled sear 132B, however, the solenoid in the mechanism 132A or 132B is preferably controlled by the electronic control circuit 230 to initiate a firing operation of the paintball gun 200A or 200B, respectively. In the electronic sear-type gun 200B of FIG. 2B, the electronic control circuit 230 generates a signal that causes the solenoid-controlled sear 132B to release the hammer 145, which is then driven forward by spring force to fire the paintball gun 200B. In the electro-pneumatic gun 200A of FIG. 2A, the electronic control circuit 230 generates a signal that causes the solenoid valve 132A to direct pressurized gas to a piston to drive a hammer 145 forward and fire the paintball gun 200A.

In the conventional electronic paintball guns 100A, 100B described previously with reference to FIGS. 1A–1C, the electronic control circuit 130 is configured to initiate a firing operation of the paintball gun in response to the closing of a microswitch 128 caused by a pull of a trigger 118. According to various principles of the present invention, however, no trigger pull is required to activate a touch-activated paintball gun. Instead, the conventional trigger 118 and trigger-activated microswitch 128 of the conventional electronic paintball gun 100A, 100B can be replaced by a touch trigger assembly.

Referring again to FIGS. 2A, 2B, and 3, a touch trigger assembly can include a fixed (or moveable) trigger 218, one or more touch plates 222 arranged on the trigger 218, a grip contact 224, and a touch trigger circuit 400. The touch trigger circuit 400 preferably includes a switching mechanism 410, such as a relay. The touch trigger circuit 400 can be configured to sense and respond to contact with human skin or, in an alternative embodiment, the circuit 400 can be configured to be responsive to a contact member arranged on a glove, such as an electrical contact on a fingertip of a glove. Configuring the trigger circuit 400 to respond to contact with human skin or a specialized glove can be accomplished in a number of ways, all of which are considered within the scope of this invention.

In a preferred embodiment, an operator holds the grip 220 with the same hand used to actuate the trigger. The palm of the operator's hand contacts the grip contact 224. When the operator touches the touch plate 222 on the trigger 218 with a finger on his or her operating hand, the contact between the palm of the hand and the grip contact 224 and between the finger and the trigger touch plate 222 closes a circuit in the touch trigger circuit 400and activates the switching mechanism 410. The actuation of the switching mechanism 410 presents an activation signal to the electronic control circuit 230, which then initiates a firing operation of the paintball gun 200. In an alternative embodiment, the touch trigger circuit can be configured to sense a change in an electrical characteristic of the touch plate (such as reactance) due to skin or specialized glove contact.

Figure 4:
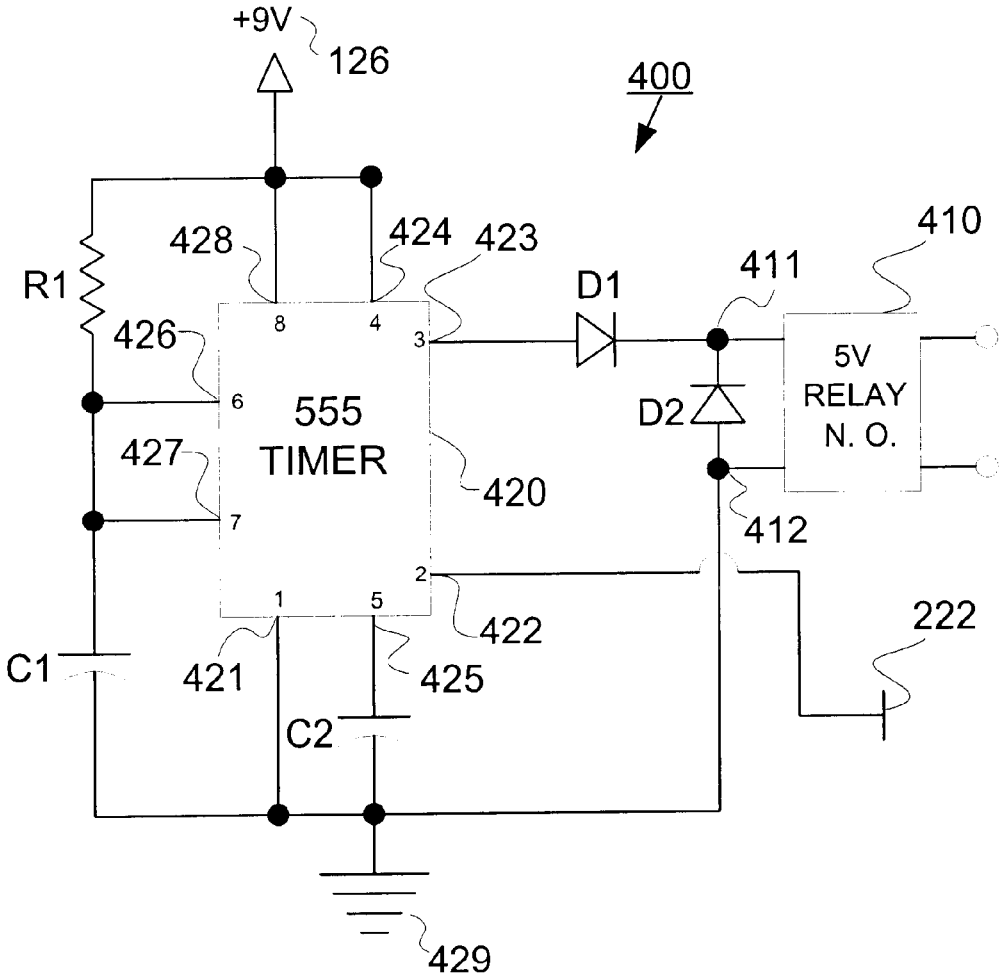
FIG. 4 is a schematic circuit diagram of a touch trigger circuit of the electronic control system of FIG. 3 according to yet another aspect of the present invention.

FIG. 4 is a schematic circuit diagram of one possible embodiment of a touch trigger circuit 400. Referring to FIG. 4, the touch trigger circuit 400 can include a 555 timer 420, a switching mechanism (e.g., a relay) 410, and various capacitive and resistive elements. The 555 timer 420 preferably includes eight pins. In a preferred configuration, a first pin 421 is connected to a ground terminal 429. A second pin 422 is connected to a touch plate 222, that can preferably be arranged on a trigger of the paintball gun. A third pin 423 is connected via a first diode D1 to a first input 411 of the relay 410. A fourth pin 424 and an eighth pin 428 are connected in common to a supply voltage and one end of a resistor R1. A sixth pin 426 and a seventh pin 427 are connected in common to the other end of the resistor R1 and a first end of a first capacitor C1. The second end of the first capacitor C1 is connected to the ground terminal 429. A fifth pin 425 is connected to a first end of a second capacitor C2, while the second end of the second capacitor C2 is connected to the ground terminal 429.

A second diode D2 is preferably arranged between the input terminals of the relay 410, with a first end of the diode D2 being connected to a second input terminal 412 of the relay 410 and a second end of the diode D2 being connected to the first input terminal 411 of the relay 410. The second input terminal 412 of the relay 410 is preferably also connected to the ground terminal 429. The ground terminal 429 is preferably connected to a contact member 224 that can be arranged on the grip of the paintball gun.

Operation of this embodiment of the touch trigger circuit 400 will be described with reference to FIGS. 2A, 3, and 4. In operation, the 555 timer energizes the touch plate 222 on a trigger 218 through the second pin 422. The ground terminal 429 is preferably connected to a contact member 224 arranged on the grip handle 122 of the paintball gun. When an operator holds the grip handle 120, the palm of the operator's hand preferably contacts the grounding contact 224 on the grip 220. Simultaneous contact between the user's hand and both the grounding contact 224 and the touch plate 222 connected to the second pin 422 causes a pulse to be generated from the third pin 423 to drive the relay 410. By changing the values for the first resistor R1 and first capacitor C1, the duration of the pulse, and, therefore how quickly the trigger reacts to consecutive touches can be controlled. The second capacitor C2 preferably helps prevent accidental actuation of the touch trigger circuit 400.

Figure 5:
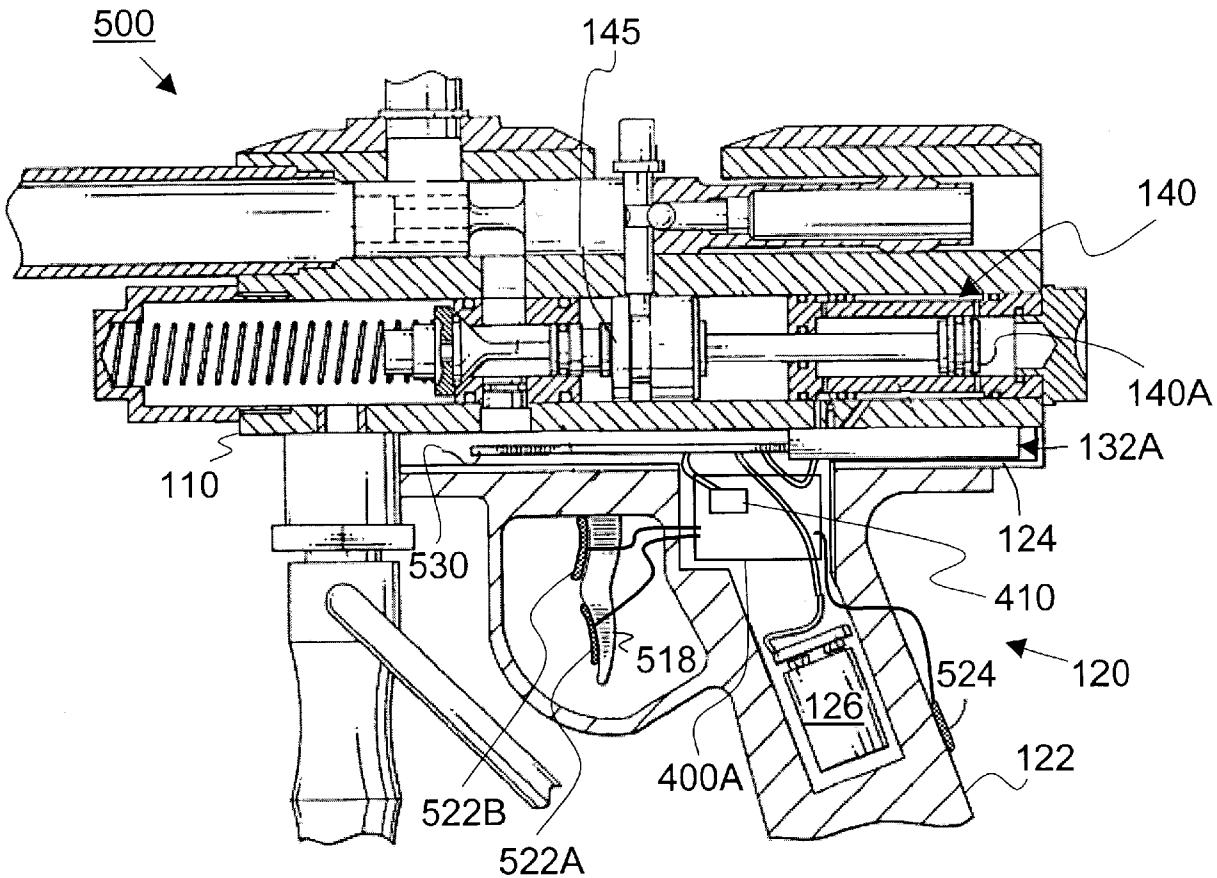
FIG. 5 is a schematic cross-sectional view of a paintball gun including a touch trigger circuit having multiple touch plates according to yet another embodiment of the present invention.

FIG. 5 is a schematic cross-sectional view of a touch-activated paintball gun 500 constructed according to another alternative embodiment of the present invention. Referring to FIG. 5, a touch activated paintball gun 500 can include multiple touch plates 522A, 522B arranged on a trigger 518 (or elsewhere on the paintball gun or remote from the paintball gun, if desired). Each of the touch plates 522A, 522B is preferably connected to a common touch circuit 400A or separate touch circuits.

In this particular embodiment, the touch circuit 400A is preferably configured to separately detect contact to first and second touch plates 522A, 522B, respectively. The touch circuit 400A is preferably further configured to initiate various firing modes depending on which of the first and second touch plates 522A, 522B are contacted. If only the first touch plate 522A is contacted, for example, a semi-auto firing mode can be initiated. If only the second touch plate 522B is contacted, a burst firing mode could be initiated. If both touch plates 522A, 522B are contacted, a full-auto firing mode could be initiated. Any other firing modes or gun functions could be configured to be initiated depending on the sequence and/or combinations in which the touch plates are contacted.

Having described and illustrated the principles of the invention with respect to various preferred embodiments thereof, it should be apparent that the invention can be modified in arrangement and detail without departing from such principles. In yet another alternative embodiment, for example, a hybrid paintball gun could be constructed in which a user could selectively operate in touch mode or a conventional mode. A switch could be configured to select between the modes. Alternatively, a moveable trigger could be configured to operate the gun in touch mode when contact with human skin is detected or to operate in conventional mode when the trigger does not contact human skin, but is pulled back sufficiently to contact a microswitch. Hybrid touch and mechanical actuation embodiments are also possible.

Numerous other modifications and variations to the foregoing embodiments are possible and will be apparent to those skilled in the art. The appended claims should therefore be interpreted to cover all such modifications and variations.

What is claimed is:

1. A touch-activated paintball gun, comprising:

a gun body;

a grip frame comprising a trigger and a grip, wherein the trigger comprises an electrical contact;

a gun control circuit; and a touch trigger circuit comprising a switching mechanism, wherein the touch trigger circuit is configured to activate the switching mechanism in response to contact with the electrical contact of the trigger.

2. A paintball gun according to claim 1, further comprising a power source configured to supply power to the paintball gun control circuit and the touch trigger circuit.

3. A paintball gun according to claim 1, wherein the grip comprises an electrical contact connected to ground.

4. A paintball gun according to claim 3, wherein simultaneous contact between a user's hand and the electrical contact of the grip and between the user's hand and the electrical contact of the trigger activates the switching mechanism in the touch trigger circuit.

5. A paintball gun according to claim 4, wherein the switching mechanism is configured to control an operation of the paintball gun control circuit.

6. A paintball gun according to claim 5, wherein activation of the switching mechanism in the touch trigger circuit initiates a firing operation of the paintball gun.

7. A paintball gun according to claim 1, wherein the switching mechanism is a relay.

8. A paintball gun according to claim 1, wherein the trigger is fixed in place relative to the grip.

9. A paintball gun according to claim 8, wherein the electrical contact of the trigger comprises a touch plate.

10. A touch-activated trigger system for a paintball gun comprising:

a trigger comprising a touch plate;

a trigger circuit comprising a switching mechanism, wherein contact between a user's skin and the touch plate activates the switching mechanism of the trigger circuit; and a paintball gun control circuit, wherein activation of the switching mechanism of the trigger circuit initiates an operation of the paintball gun control circuit.

11. A system according to claim 10, wherein the operation of the paintball gun control circuit is a firing operation of the paintball gun.

12. A system according to claim 10, further comprising a ground terminal; wherein simultaneous contact between the user's skin and both the touch plate and the ground terminal activates the switching mechanism of the trigger circuit.

13. A system according to claim 12, wherein the switching mechanism is a relay.

14. A system according to claim 12, wherein the ground terminal is arranged in a grip of the paintball gun.

15. A touch trigger circuit for a paintball gun, said circuit comprising:

a first electrical contact;

a power supply connection configured to receive power for the circuit; and a switching mechanism configured to initiate an operation in a control circuit of a paintball gun, wherein contact between a user's skin and the first electrical contact is capable of activating the switching mechanism.

16. A circuit according to claim 15, further comprising a timing circuit.

17. A circuit according to claim 15, wherein the switching mechanism is a relay.

18. A circuit according to claim 15, further comprising a second electrical contact; wherein simultaneous contact between a user's skin and the first and second electrical contacts activates the switching mechanism.

19. A circuit according to claim 15, further comprising a sensor configured to sense a change in an electrical characteristic due to contact between the user's skin and the first electrical contact.

20. A circuit according to claim 19, wherein the circuit is configured to actuate the switching mechanism in response to detection by the sensor of contact between the user's skin and the first electrical contact.

* * * * *